US007648949B2

(12) United States Patent
Vilardo et al.

(10) Patent No.: US 7,648,949 B2
(45) Date of Patent: Jan. 19, 2010

(54) LOW PHOSPHORUS COBALT COMPLEX-CONTAINING ENGINE OIL LUBRICANT

(75) Inventors: Jonathan S. Vilardo, Willoughby, OH (US); Jason R. Brown, North Ridgeville, OH (US); William D. Abraham, Concord, OH (US); Patrick E. Mosier, Bay Village, OH (US); Paul E. Adams, Willoughby, OH (US); Douglas T. Jayne, Novelty, OH (US); Richard M. Lange, Euclid, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 301 days.

(21) Appl. No.: 11/044,384

(22) Filed: Jan. 27, 2005

(65) Prior Publication Data

US 2006/0166842 A1 Jul. 27, 2006

(51) Int. Cl.
*C10M 159/18* (2006.01)
*C10M 169/04* (2006.01)
*C10M 159/24* (2006.01)

(52) U.S. Cl. ..... 508/362; 508/368; 508/287; 508/391

(58) Field of Classification Search ..... 508/287, 508/362, 368, 391
See application file for complete search history.

(56) References Cited

U.S. PATENT DOCUMENTS

| | | | | |
|---|---|---|---|---|
| 3,244,627 | A * | 4/1966 | Smith et al. | 508/249 |
| 4,849,123 | A * | 7/1989 | Tipton et al. | 252/75 |
| 4,941,984 | A * | 7/1990 | Chamberlin et al. | 508/237 |
| 4,952,328 | A | 8/1990 | Davis et al. | 252/32.7 E |
| 4,981,602 | A | 1/1991 | Ripple et al. | 252/32.7 E |
| 5,320,765 | A | 6/1994 | Fetterman, Jr. et al. | 252/32.7 E |
| 5,728,656 | A * | 3/1998 | Yamaguchi et al. | 508/371 |
| 6,559,105 | B2 * | 5/2003 | Abraham et al. | 508/186 |
| 6,605,572 | B2 * | 8/2003 | Carrick et al. | 508/198 |

FOREIGN PATENT DOCUMENTS

| | | | |
|---|---|---|---|
| WO | WO 87/04454 | | 7/1987 |
| WO | WO 8704454 | A * | 7/1987 |
| WO | WO 96/12779 | | 5/1996 |
| WO | WO 9612779 | A * | 5/1996 |
| WO | WO 0129157 | | 4/2001 |
| WO | WO 02/062930 | | 8/2002 |
| WO | WO 02062930 | A * | 8/2002 |

OTHER PUBLICATIONS

Corresponding PCT Search Report for International Application No. PCT/US2006/003105; date of mailing of search report: Jun. 8, 2006.
RU2237705 Database WPI/Derwent Abstract, Section Ch, Week 200503, Derwent Publications Ltd., London, GB (Oct. 10, 2004).

* cited by examiner

*Primary Examiner*—Glenn Caldarola
*Assistant Examiner*—Jim Goloboy
(74) *Attorney, Agent, or Firm*—Christopher D. Hilker; David M. Shold

(57) ABSTRACT

Organo-Cobalt complexes having long chain saturated and unsaturated alkyl functionality as multifunctional additives in crankcase oils and the method of preparation thereof.

10 Claims, No Drawings

LOW PHOSPHORUS COBALT COMPLEX-CONTAINING ENGINE OIL LUBRICANT

BACKGROUND OF THE INVENTION

The present invention relates to a low phosphorus lubricant composition and method for lubricating an internal combustion engine, providing improved oxidation resistance, wear and friction reduction.

The impending low phosphorus and low sulfur restrictions proposed in GF-4 PC-10 engine oil specifications have caused the need to invent new engine oil additives to supplement and eventually replace zinc dialkyl dithiophosphates, ZDP. In engine oil formulations, ZDP is the largest contributor of phosphorus to the additive package, hence the industry must lower the amount of ZDP in additive packages to meet current and future engine oil requirements.

The present invention was developed to solve the problem of lowering the phosphorus levels in an internal combustion lubricant while maintaining or improving oxidation resistance, wear and friction reduction. The invention provides a zero phosphorus anti-wear additives with the potential to serve as friction modifiers and antioxidants in PCMO, HD, and other applications.

U.S. Pat. No. 4,952,328, Davis et al., Aug. 28, 1990, discloses lubricating oil compositions for internal combustion engines, comprising (A) oil of lubricating viscosity, (B) a carboxylic derivative produced by reacting a succinic acylating agent with certain amines, and (C) a basic alkali metal salt of sulfonic or carboxylic acid. An illustrative lubricant composition (Lubricant III) includes base oil including viscosity index modifier; a basic magnesium alkylated benzene sulfonate; an overbased sodium alkylbenzene sulfonate; a basic calcium alkylated benzene sulfonate; succinimide dispersant; and zinc salts of phosphorodithioic acids.

U.S. Pat. No. 4,981,602, Ripple et al., Jan. 1, 1991, discloses lubricating oil composition for internal combustion engines, comprising (a) an oil of lubricating viscosity, (b) at least one carboxylic derivative produced by reacting a succinic acylating agent with certain amines, and (c) at least one metal salt of a dihydrocarbyl dithiophosphoric acid produced by reacting phosphorus pentasulfide with an alcohol mixture, wherein the alcohol mixture comprises isopropyl alcohol and aliphatic alcohol and the metal is a Group II metal, aluminum, tin, iron, cobalt, lead, molybdenum, manganese, nickel or copper.

SUMMARY OF THE INVENTION

The invention therefore provides a low phosphorus lubricant composition comprising:

(a) an oil of lubricating viscosity;

(b) an oil soluble cobalt complex or salt; and (c) at least one of:

(i) dispersants; and (ii) detergents.

The invention also provides the above lubricant composition, wherein the oil soluble cobalt complex or salt is selected from the group consisting of hydrocarbyl substituted cobalt sulfanyl alkanoates, hydrocarbyl substituted cobalt sulfonates, hydrocarbyl substituted cobalt salicylaldimines, cobalt dihydrocarbyldithiocarbamates, and hydrocarbyl substituted cobalt dithiophosphates.

It further provides a method of lubricating an internal combustion engine, comprising supplying the lubricant composition to the engine.

DETAILED DESCRIPTION OF THE INVENTION

Various preferred features and embodiments will be described below by way of non-limiting illustration.

The present invention provides a composition as described above. Often the composition has total sulfur content in one embodiment below 0.4 percent by weight, in another embodiment below 0.3 percent by weight, in yet another embodiment 0.2 percent by weight or less and in yet another embodiment 0.1 percent by weight or less. Often the major source of sulfur in the composition of the invention is derived from conventional diluent oil. A typical range for the total sulfur content is 0.1 to 0.01 percent by weight.

Often the composition has a total phosphorus content of less than or equal to 800 ppm, in another embodiment equal to or less than 500 ppm, in yet another embodiment equal to or less than 300 ppm, in yet another embodiment equal to or less than 200 ppm and in yet another embodiment equal to or less than 100 ppm of the composition. A typical range for the total phosphorus content is 500 to 100 ppm.

Often the composition has a total sulfated ash content as determined by ASTM D-874 of below 1.2 percent by weight, in one embodiment equal to or less than 1.0 or less than 0.7 percent by weight, in yet another embodiment equal to or less than 0.4 percent by weight, in yet another embodiment equal to or less than 0.3 percent by weight and in yet another embodiment equal to or less than 0.05 percent by weight of the composition. A typical range for the total sulfated ash content is 0.7 to 0.05 percent by weight.

Oil of Lubricating Viscosity

The lubricating oil composition comprises of one or more base oils which are generally present in a major amount (i.e. an amount greater than 50 percent by weight). Generally, the base oil is present in an amount greater than 60 percent, or greater than 70 percent, or greater than 80 percent by weight of the lubricating oil composition. In one embodiment the base oil sulfur content can be 0.001 to 0.2 percent by weight, in another embodiment 0.0001 to 0.1 or 0.05 percent by weight.

The lubricating oil composition may have a kinematic viscosity as measured in ASTM D445, of up to about 16.3 $mm^2/s$ at 100° C., and in one embodiment 5 to 16.3 $mm^2/s$ (cSt) at 100° C., and in one embodiment 6 to 13 $mm^2/s$ (cSt) at 100° C. In one embodiment, the lubricating oil composition has an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40 or 10W-50.

The lubricating oil composition may have a high-temperature/high-shear viscosity at 150° C. as measured by the procedure in ASTM D4683 of up to 4 $mm^2/s$ (cSt), and in one embodiment up to 3.7 $mm^2/s$ (cSt), and in one embodiment 2 to 4 $mm^2/s$ (cSt), and in one embodiment 2.2 to 3.7 $mm^2/s$ (cSt), and in one embodiment 2.7 to 3.5 $mm^2/s$ (cSt).

The base oil used in the lubricant composition may be a natural oil, synthetic oil or mixture thereof, provided the sulfur content of such oil does not exceed the above-indicated sulfur concentration limit required for the inventive low-sulfur, low-phosphorus, low-ash lubricating oil composition. The natural oils that are useful include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. Oils derived from coal or shale are also useful. Synthetic lubricating oils include hydrocarbon oils such as polymerized and interpolymerized olefins (e.g., polybutylenes, polypropylenes, and propylene isobutylene copolymers); poly(1-hexenes), poly-(1-octenes), poly(1-decenes), etc. and mixtures thereof; alkylbenzenes (e.g., dodecylbenzenes, tetradecylbenzenes, dinonylbenzenes, and di-(2-ethylhexyl)benzenes); polyphenyls (e.g., biphenyls, terphenyls, alkylated polyphenyls); alkylated diphenyl ethers and the derivatives, analogs and homologs thereof.

Alkylene oxide polymers and interpolymers and derivatives thereof where the terminal hydroxyl groups have been modified by e.g., esterification, etherification, constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polypropylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, for example, the acetic acid esters, mixed $C_3$-$C_8$ fatty acid esters, or the carboxylic acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, dodecanedioic acid) with a variety of alcohols (e.g., butyl alcohol, hexyl alcohol, dodecyl alcohol, 2-ethylhexyl alcohol, ethylene glycol, diethylene glycol monoether and propylene glycol) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer and the complex ester formed by reacting one mole of sebacic acid with two moles of tetraethylene glycol and two moles of 2-ethylhexanoic acid.

Esters useful as synthetic oils also include those made from C5 to C12 monocarboxylic acids and polyols and polyol ethers such as neopentyl glycol, trimethylol propane, pentaerythritol, dipentaerythritol and tripentaerythritol.

The oil can be a poly-alpha-olefin (PAO). Typically, the PAOs are derived from monomers having from 4 to 30, or from 4 to 20, or from 6 to 16 carbon atoms. Examples of useful PAOs include those derived from octene, decene and mixtures thereof. These PAOs may have a viscosity from 2 to 15, or from 3 to 12, or from 4 to 8 $mm^2/s$ (cSt), at 100° C. Examples of useful PAOs include 4 $mm^2/s$ (cSt) at 100° C. poly-alpha-olefins, 6 $mm^2/s$ (cSt) at 100° C. poly-alpha-olefins, and mixtures thereof. Mixtures of mineral oil with one or more of the foregoing PAOs may be used.

Unrefined, refined and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

Additionally, synthetic oils may be produced by Fischer-Tropsch gas to liquid synthetic procedure as well as other gas-to-liquid oils. In one embodiment the polymer composition of the present invention is useful when employed in a gas-to-liquid oil. Often Fischer-Tropsch hydrocarbons or waxes may be hydroisomerised.

Cobalt Complex

The oil soluble cobalt complex or salt can include materials in which the cobalt is complexed with one or more O, N, or S atoms. Some examples can include hydrocarbyl substituted cobalt sulfanyl alkanoates, hydrocarbyl substituted cobalt sulfonates, hydrocarbyl substituted cobalt salicylaldimines, cobalt dihydrocarbyldithiocarbamates, and hydrocarbyl substituted cobalt dithiophosphates. The cobalt sulfanyl alkanoates complex can be prepared from an alkylsulfanyl-carboxylic acid and cobalt hydroxide reaction, as shown in the following formulation.

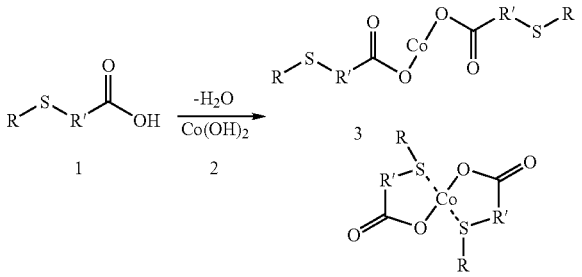

wherein R can be $C_8$ to $C_{30}$ saturated or unsaturated alkyl group and R' can be $C_1$ to $C_{10}$ saturated or unsaturated alkylene group. Formula 1 is an alkylsulfanyl-carboxylic acid, formula 2 is cobalt hydroxide and formula 3 is alternative representations of a cobalt sulfanyl alkanoates complex. Formula 3 can also be prepared by reaction of an alkylsulfanyl carboxylic acid with a cobalt salt of a weekly acidic carboxylic acid have a pKa of about 5 to 6. Procedures for preparing such material are well known and within the abilities of the person skilled in the art.

The hydrocarbyl substituted cobalt sulfonates can be prepared from an alkyl benzyl sulfonic acid and cobalt hydroxide reaction, as shown in the following formulation.

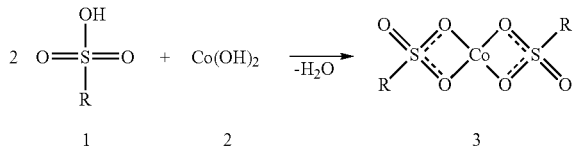

wherein R can be a linear or branched alkyl benzene with a $C_{10}$-$C_{30}$ tail. Formula 1 is alkyl benzyl sulfonic acid, formula 2 is cobalt hydroxide and formula 3 is the hydrocarbyl substituted cobalt sulfonate complex. Procedures for preparing such material are well known and within the abilities of the person skilled in the art.

The hydrocarbyl substituted cobalt salicylaldimines can be prepared from salicylaldehyde, alkyl amine, and cobalt hydroxide in a two-step reaction, as shown in the following formulation.

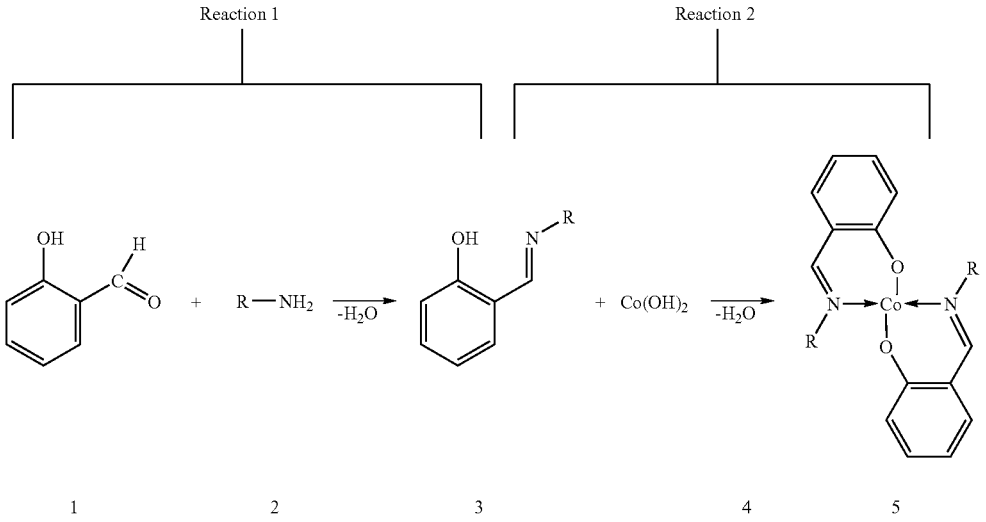

wherein R can be $C_8$ to $C_{30}$ saturated or unsaturated alkyl group. The first reaction is between salicylaldehyde (or a hydrocarbyl-substituted salicylaldehyde), as shown in formula 1, and a primary alkyl amine, as shown in formula 2, to produce alkyl salicyldimine ligand, as shown in formula 3. In the second reaction formula 3 is reacted with cobalt hydroxide as shown in formula 4, to produce the hydrocarbyl substituted cobalt salicylaldimines complex as shown in formula 5. In another embodiment the amine of formula 2 can be a diamine $H_2N—R—NH_2$ and the corresponding intermediate of formula 3 can have the structure.

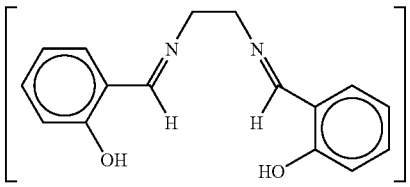

Procedures for preparing such material are well known and within the abilities of the person skilled in the art. Preparation of similar material can be found in Anal. Chim. Acta, 30 (1964) 84-90 and J. Am. Chem. Soc., 62 (1940)1228.

The cobalt di-hydrocarbyldithiocarbamates can be prepared from a carbon disulfide, a secondary alkyl amine, and cobalt hydroxide reaction, as shown in the following formulation.

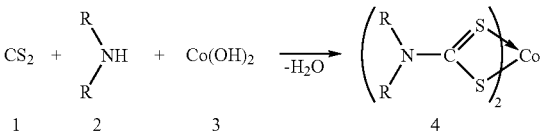

wherein each R can independently be $C_8$ to $C_{30}$ saturated or unsaturated alkyl group. Formula 1 is carbon disulfide, formula 2 is secondary alkyl amine, formula 3 is cobalt hydroxide and formula 4 is the cobalt dihydrocarbyldithiocarbamates complex. Procedures for preparing such material are well known and within the abilities of the person skilled in the art. Preparation of similar material can be found in Inorganica Chimica Acta., 157 (1989) 209-214 and Inorganica Chimica Acta., 86 (1984) 127-131.

The hydrocarbyl substituted cobalt dithiophospate complex can be prepared from a dihydrocarbyl-dithiophosphate acid and cobalt hydroxide reaction, as shown in the following formulation.

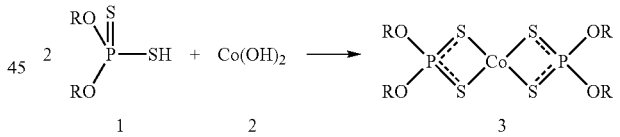

wherein R can be a linear or branched alkyl benzene with a $C_1$-$C_{30}$ tail. Formula 1 is a dialkyl-dithiophosphoric acid, formula 2 is cobalt hydroxide and formula 3 is the hydrocarbyl substituted cobalt dithiophospate complex. Procedures for preparing such material are well known and within the abilities of the person skilled in the art. Additionally, the preparation of this product can be analogous to the well known procedure of the synthesis of the corresponding zinc salts.

The obvious structures are for illustration only and are not intended to limit the scope of the present invention. No representation is made that the products will necessarily have the structures shown.

In one embodiment, the amount of cobalt delivered from the cobalt complex in the present invention can be 1 to 1000 part per million (ppm); in another embodiment, 10 to 1000 parts per million, or 15 to 750 parts per million, or 20 to 500 parts per million or 25 to 400 parts per million.

Dispersant

The dispersants of the present invention can be derived from N-substituted long chain alkenyl succinimides.

These succinimide dispersants are well known in the field of lubricants and include primarily what are sometimes referred to as "ashless" dispersants because (prior to mixing in a lubricating composition) they do not contain ash-forming metals and they do not normally contribute any ash forming metals when added to a lubricant. Succinimide dispersants are the reaction product of a hydrocarbyl substituted succinic acylating agent with amine such as a polyamine or hydroxyl-containing amine. The term "succinic acylating agent" refers to a hydrocarbon-substituted succinic acid or succinic acid-producing compound (which term also encompasses the acid itself). Such materials typically include hydrocarbyl-substituted succinic acids, anhydrides, esters (including half esters) and halides.

Succinic based dispersants (succinimide dispersants) have a wide variety of chemical structures including typically structures such as

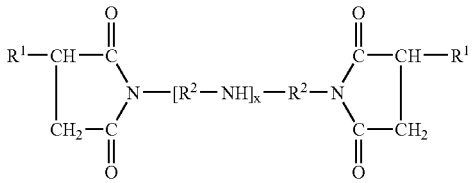

In the above structure, each $R^1$ is independently a hydrocarbyl group, which may be bound to multiple succinimide groups, typically a polyolefin-derived group having an $\overline{M}_n$ of 500 or 700 to 10,000. Typically the hydrocarbyl group is an alkyl group, frequently a polyisobutylene group with a molecular weight of 500 or 700 to 5000, alternatively 1500 or 2000 to 5000. Alternatively expressed, the $R^1$ groups can contain 40 to 500 carbon atoms and in one embodiment at least 50, e.g., 50 to 300 carbon atoms, e.g., aliphatic carbon atoms. The $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Succinimide dispersants are more fully described in U.S. Pat. Nos. 4,234,435, 3,172,892, and 6,165,235.

The polyalkenes from which the substituent groups are derived are typically homopolymers and interpolymers of polymerizable olefin monomers of 2 to 16 carbon atoms; usually 2 to 6 carbon atoms.

The olefin monomers from which the polyalkenes are derived are polymerizable olefin monomers characterized by the presence of one or more ethylenically unsaturated groups (i.e., >C═C<); that is, they are mono-olefinic monomers such as ethylene, propylene, 1-butene, isobutene, and 1-octene or polyolefinic monomers (usually diolefinic monomers) such as 1,3-butadiene, and isoprene. These olefin monomers are usually polymerizable terminal olefins; that is, olefins characterized by the presence in their structure of the group >C═$CH_2$. Relatively small amounts of non-hydrocarbon substituents can be included in the polyolefin, provided that such substituents do not substantially interfere with formation of the substituted succinic acid acylating agents.

Each $R^1$ group may contain one or more reactive groups, e.g., succinic groups, thus being represented (prior to reaction with the amine) by structures such as

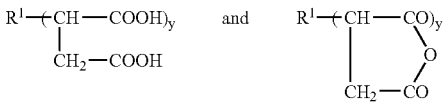

in which y represents the number of such succinic groups attached to the $R^1$ group. In one type of dispersant, y=1. In another type of dispersant, y is greater than 1, in one embodiment greater than 1.3 or greater than 1.4; and in another embodiment y is equal to or greater than 1.5. in one embodiment y is 1.4 to 3.5, such as 1.5 to 3.5 or 1.5 to 2.5. Fractional values of y, of course, can arise because different specific $R^1$ chains may be reacted with different numbers of succinic groups.

The amines which are reacted with the succinic acylating agents to form the carboxylic dispersant composition can be monoamines or polyamines. In either case they will be characterized by the formula $R^4R^5NH$ wherein $R^4$ and $R^5$ are each independently hydrogen, hydrocarbon, amino-substituted hydrocarbon, hydroxy-substituted hydrocarbon, alkoxy-substituted hydrocarbon, amino, carbamyl, thiocarbamyl, guanyl, or acylimidoyl groups provided that no more than one of $R^4$ and $R^5$ is hydrogen. In all cases, therefore, they will be characterized by the presence within their structure of at least one H—N<group. Therefore, they have at least one primary (i.e., $H_2N$—) or secondary amino (i.e., H—N<) group. Examples of monoamines include ethylamine, diethylamine, n-butylamine, di-n-butylamine, allylamine, isobutylamine, cocoamine, stearylamine, laurylamine, methyllaurylamine, oleylamine, N-methyl-octylamine, dodecylamine, and octadecylamine.

The polyamines from which the dispersant is derived include principally alkylene amines conforming, for the most part, to the formula

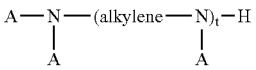

wherein t is an integer typically less than 10, A is hydrogen or a hydrocarbyl group typically having up to 30 carbon atoms, and the alkylene group is typically an alkylene group having less than 8 carbon atoms. The polyalkylene amines include principally, polyethylene amines, hexylene amines, heptylene amines, octylene amines, other polymethylene amines. They are exemplified specifically by: ethylene diamine, diethylene triamine, triethylene tetramine, propylene diamine, decamethylene diamine, octamethylene diamine, di(heptamethylene)triamine, tripropylene tetramine, hexamethylene diamine, tetraethylene pentamine, trimethylene diamine, pentaethylene hexamine, di(-trimethylene)triamine. Higher homologues such as are obtained by condensing two or more of the above-illustrated alkylene amines likewise are useful. Tetraethylene pentamine is particularly useful.

The ethylene amines, also referred to as polyethylene polyamines, are especially useful. They are described in some detail under the heading "Ethylene Amines" in Encyclopedia of Chemical Technology, Kirk and Othmer, Vol. 5, pp. 898-905, Interscience Publishers, New York (1950).

Hydroxyalkyl-substituted alkylene amines, i.e., alkylene amines having one or more hydroxyalkyl substituents on the nitrogen atoms, likewise are useful. Examples of such amines include N-(2-hydroxyethyl)ethylene diamine, N,N'-bis(2-hydroxyethyl)-ethylene diamine, 1-(2-hydroxyethyl)piperazine, monohydroxypropyl)-piperazine, di-hydroxypropy-substituted tetraethylene pentamine, N-(3-hydroxypropyl)-tetra-methylene diamine, and 2-heptadecyl-1-(2-hydroxyethyl)-imidazoline.

Higher homologues such as are obtained by condensation of the above-illustrated alkylene amines or hydroxy alkyl-substituted alkylene amines through amino radicals or through hydroxy radicals, are likewise useful. Condensed polyamines are formed by a condensation reaction between at least one hydroxy compound with at least one polyamine reactant containing at least one primary or secondary amino group and are described in U.S. Pat. No. 5,230,714 (Steckel).

The succinimide dispersant is referred to as such since it normally contains nitrogen largely in the form of imide functionality, although it may be in the form of amine salts, amides, imidazolines as well as mixtures thereof. To prepare the succinimide dispersant, one or more of the succinic acid-producing compounds and one or more of the amines are heated, typically with removal of water, optionally in the presence of a normally liquid, substantially inert organic liquid solvent/diluent at an elevated temperature, generally in the range of 80° C. up to the decomposition point of the mixture or the product; typically 100° C. to 300° C.

The succinic acylating agent and the amine (or organic hydroxy compound, or mixture thereof) are typically reacted in amounts sufficient to provide at least one-half equivalent, per equivalent of acid-producing compound, of the amine (or hydroxy compound, as the case may be). Generally, the maximum amount of amine present will be about 2 moles of amine per equivalent of succinic acylating agent. For the purposes of this invention, an equivalent of the amine is that amount of the amine corresponding to the total weight of amine divided by the total number of nitrogen atoms present. The number of equivalents of succinic acid-producing compound will vary with the number of succinic groups present therein, and generally, there are two equivalents of acylating reagent for each succinic group in the acylating reagents. Additional details and examples of the procedures for preparing the succinimide dispersants of the present invention are included in, for example, U.S. Pat. Nos. 3,172,892; 3,219,666; 3,272,746; 4,234,435; 6,440,905 and 6,165,235.

The dispersants may be borated materials. Borated dispersants are well-known materials and can be prepared by treatment with a borating agent such as boric acid. Typical conditions include heating the dispersant with boric acid at 100 to 150° C. The dispersants may also be treated by reaction with maleic anhydride as described in WO00/26327.

In one embodiment, the amount of the succinimide dispersant in a completely formulated lubricant will typically be 1.0 to 20 percent by weight; in another embodiment, 1 to 15 percent by weight or 1 to 10 percent by weight, or 2 to 10 percent by weight. Its concentration in a concentrate will be correspondingly increased to, e.g., 15 to 80 weight percent.

Many other types of ashless dispersants are known in the art and can be used in the present invention. Such materials are commonly referred to as "ashless" even though they may associate with a metal ion from another source in situ.

(1) "Carboxylic dispersants" are reaction products of carboxylic acylating agents (acids, anhydrides, esters, etc.) containing at least 34 and preferably at least 54 carbon atoms which are reacted with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imide, amide, and ester reaction products of carboxylic ester dispersants.

The carboxylic acylating agents include fatty acids, isoaliphatic acids (e.g. 8-methyl-octadecanoic acid), dimer acids, addition dicarboxylic acids 4+2 and 2+2 addition products of an unsaturated fatty acid with an unsaturated carboxylic reagent), trimer acids, addition tricarboxylic acids (Empol® 1040, Hystrene® 5460 and Unidyme® 60), and hydrocarbyl substituted carboxylic acylating agents (from olefins and/or polyalkenes). In one embodiment, the carboxylic acylating agent is a fatty acid. Fatty acids generally contain from 8 up to 30, or from 12 up to 24 carbon atoms. Carboxylic acylating agents are taught in U.S. Pat. Nos. 2,444,328, 3,219,666, 4,234,435 and 6,077,909.

The amine may be a mono- or polyamine. The monoamines generally have at least one hydrocarbyl group containing from 1 to 24 carbon atoms, or from 1 to 12 carbon atoms. Examples of monoamines include fatty (C8-30) amines (Armeens™), primary ether amines (SURFAM® amines), tertiary-aliphatic primary amines (Primenes™), hydroxyamines (primary, secondary or tertiary alkanol amines), ether N-(hydroxyhydrocarbyl)amines, and hydroxyhydrocarbyl amines (Ethomeens™ and Propomeens™). The polyamines include alkoxylated diamines (Ethoduomeens™), fatty diamines (Duomeens™), alkylene-polyamines (ethylenepolyamines), hydroxy-containing polyamines, polyoxyalkylene polyamines (Jeffamines™), condensed polyamines (a condensation reaction between at least one hydroxy compound with at least one polyamine reactant containing at least one primary or secondary amino group), and heterocyclic polyamines. Useful amines include those disclosed in U.S. Pat. No. 4,234,435 (Meinhart) and U.S. Pat. No. 5,230,714 (Steckel).

Examples of these "carboxylic dispersants" are described in British Patent 1,306,529 and in many U.S. patents including the following: U.S. Pat. Nos. 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, 6,077,909 and 6,165,235.

(2) "Amine dispersants" are reaction products of relatively high molecular weight aliphatic halides and amines, preferably polyalkylene polyamines. Examples thereof are described, for example, in the following U.S. patents: U.S. Pat. Nos. 3,275,554, 3,438,757, 3,454,555, and 3,565,804.

(3) "Mannich dispersants" are the reaction products of alkyl phenols in which the alkyl group contains at least 30 carbon atoms with aldehydes (especially formaldehyde) and amines (especially polyalkylene polyamines). The materials described in the following U.S. patents are illustrative: U.S. Pat. Nos. 3,036,003, 3,236,770, 3,414,347, 3,448,047, 3,461,172, 3,539,633, 3,586,629, 3,591,598, 3,634,515, 3,725,480, 3,726,882, and 3,980,569.

(4) Post-treated dispersants are obtained by reacting carboxylic, amine or Mannich dispersants with reagents such as dimercaptothiadiazoles, urea, thiourea, carbon disulfide, aldehydes, ketones, carboxylic acids, hydrocarbon-substituted succinic anhydrides, nitriles epoxides, boron compounds, phosphorus compounds or the like. Exemplary materials of this kind are described in the following U.S. patents: U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422.

(5) Polymeric dispersants are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Examples of polymer dispersants thereof are disclosed in the following U.S. patents: U.S. Pat. Nos. 3,329,658, 3,449,250, 3,519,656, 3,666,730, 3,687,849, and 3,702,300.

Detergent

The composition can also contain one or more detergents, which are normally salts, and specifically overbased salts. Overbased salts, or overbased materials, are single phase, homogeneous Newtonian systems characterized by a metal content in excess of that which would be present according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (such as mineral oil, naphtha, toluene, xylene) for said acidic organic material, a stoichiometric excess of a metal base, and a promoter.

The metal compounds useful in making the basic metal salts are generally any Group 1 or Group 2 metal compounds (CAS version of the Periodic Table of the Elements). The Group 1 metals of the metal compound include Group 1a alkali metals such as sodium, potassium, and lithium, as well as Group 1b metals such as copper, In one embodiment such metals can be sodium or potassium, and in another embodiment, sodium. The Group 2 metals of the metal base include the Group 2a alkaline earth metals such as magnesium, calcium, and barium, as well as the Group 2b metals such as zinc or cadmium. In one embodiment such metals can be magnesium, calcium, barium, or zinc, and in another embodiment magnesium or calcium. Generally the metal compounds are delivered as metal salts. The anionic portion of the salt can be hydroxide, oxide, carbonate, borate, nitrate or mixtures thereof.

Such overbased materials are well known to those skilled in the art. Patents describing techniques for making basic salts of sulfonic acids, carboxylic acids, (hydrocarbyl-substituted) phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

In one embodiment, the (TBN) invention employs a calcium sulfonate detergent with a high Total Base Number. Generally detergents with a high TBN have a nitrogen to carbonyl ratio of at least about 1.4, in one embodiment at least about 1.6, in one embodiment 1.8 or greater, in another embodiment 2.0 or greater. The nitrogen to carbonyl ratio is to be calculated on a molar basis, that is, the ratio of moles of nitrogen functionality (e.g., amine nitrogens) to the moles of carbonyl functionality (e.g., —C(O)O—). In one embodiment, a TBN value is at least 60 or 80, in another embodiment 90 to 100 in yet another embodiment 100 to 110 or 120.

Calcium sulfonate detergents are well known in the field of lubricants. In one embodiment the lubricants of the present invention can contain an overbased sulfonate detergent. Suitable sulfonic acids include sulfonic and thiosulfonic acids. Sulfonic acids include the mono- or polynuclear aromatic or cycloaliphatic compounds. Oil-soluble sulfonates can be represented for the most part by one of the following formulas: $R_2$-T-$(SO_3^-)_a$ and $R_3$—$(SO_3^-)_b$, where T is a cyclic nucleus such as typically benzene; $R_2$ is an aliphatic group such as alkyl, alkenyl, alkoxy, or alkoxyalkyl; $(R_2)$+T typically contains a total of at least about 15 carbon atoms; and $R_3$ is an aliphatic hydrocarbyl group typically containing at least 15 carbon atoms. Examples of $R_3$ are alkyl, alkenyl, alkoxyalkyl, and carboalkoxyalkyl groups. The groups T, $R_2$, and $R_3$ in the above formulas can also contain other inorganic or organic substituents in addition to those enumerated above such as, for example, hydroxy, mercapto, halogen, nitro, amino, nitroso, sulfide, or disulfide. In the above formulas, a and b are at least 1.

Another overbased material which can be present is an overbased phenate detergent. The phenols useful in making phenate detergents can be represented by the formula $(R_1)_a$—Ar—$(OH)_b$, wherein $R_1$ is a hydrocarbyl group that is directly bonded to the aromatic group Ar. In one embodiment $R_1$ contains 6 to 80 carbon atoms, 6 to 30 or 8 to 15 or 25 carbon atoms. $R_1$ groups may be derived from one or more polyalkenes. Examples of the $R_1$ groups include butyl, isobutyl, pentyl, octyl, nonyl, dodecyl, and substituents derived from the above-described polyalkenes such as polyethylenes, polypropylenes, polyisobutylenes, ethylene-propylene copolymers, and oxidized ethylene-propylene copolymers. Ar is an aromatic group (which can be a benzene group or another aromatic group such as naphthalene); a and b are independently numbers of at least one, the sum of a and b being in the range of two up to the number of displaceable hydrogens on the aromatic nucleus or nuclei of Ar. In one embodiment, a and b are independently numbers in the range of 1 to 4, or 1 to 2. $R_1$ and a are typically such that there is an average of at least 8 aliphatic carbon atoms provided by the $R_1$ groups for each phenol compound. Phenate detergents are also sometimes provided as sulfur-bridged species.

In one embodiment, the overbased material is an overbased detergent selected from the group consisting of overbased salixarate detergents, over-based saligenin detergents, overbased salicylate detergents, and overbased glyoxylate detergents, and mixtures thereof. Overbased saligenin detergents are commonly overbased magnesium salts which are based on saligenin derivatives. A general example of such a saligenin derivative can be represented by the formula

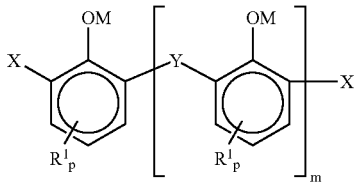

wherein X comprises —CHO or —$CH_2OH$, Y comprises —$CH_2$— or —$CH_2OCH_2$—, and wherein such —CHO groups typically comprise at least 10 mole percent of the X and Y groups; M is hydrogen, ammonium, or a valence of a metal ion, $R_1$ is a hydrocarbyl group containing 1 to 60 carbon atoms, m is 0 to typically 10, and each p is independently 0, 1, 2, or 3, provided that at least one aromatic ring contains an $R^1$ substituent and that the total number of carbon atoms in all $R^1$ groups is at least 7. When m is 1 or greater, one of the X groups can be hydrogen. In one embodiment, M is a valence of a Mg ion or a mixture of Mg and hydrogen. Other metals include alkali metals such as lithium, sodium, or potassium; alkaline earth metals such as calcium or barium; and other metals such as copper, zinc, and tin.

As used herein, the expression "represented by the formula" indicates that the formula presented is generally representative of the structure of the chemical in question. However, it is well known that minor variations can occur, including in particular positional isomerization, that is, location of the X, Y, and R groups at different position on the aromatic ring from those shown in the structure. The expression "represented by the formula" is expressly intended to encompass such variations.

Saligenin detergents are disclosed in greater detail in U.S. Pat. No. 6,310,009, with special reference to their methods of synthesis (Column 8 and Example 1) and preferred amounts of the various species of X and Y (Column 6).

Salixarate detergents are overbased materials that can be represented by a substantially linear compound comprising at least one unit of formula (I) or formula (II):

(I)

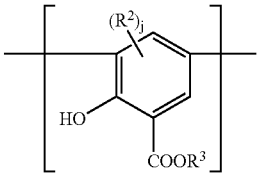

(II)

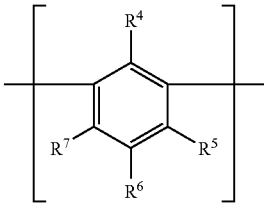

each end of the compound having a terminal group of formula (III) or formula (IV):

(III)

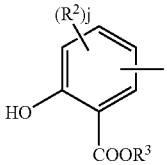

(IV)

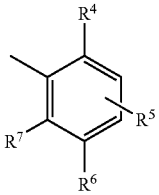

such groups being linked by divalent bridging groups A, which may be the same or different for each linkage; wherein in formulas (I)-(IV) $R^3$ is hydrogen or a hydrocarbyl group; $R_2$ is hydroxyl or a hydrocarbyl group and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in the composition is about 0.1:1 to about 2:1. The divalent bridging group "A," which may be the same or different in each occurrence, includes —$CH_2$— (methylene bridge) and —$CH_2OCH_2$— (ether bridge), either of which may be derived from formaldehyde or a formaldehyde equivalent (e.g., paraform, formalin).

Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

Glyoxylate detergents are similar overbased materials which are based on an anionic group which, in one embodiment, may have the structure

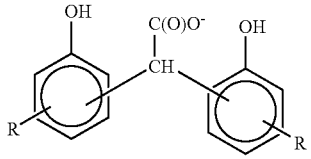

and more specifically,

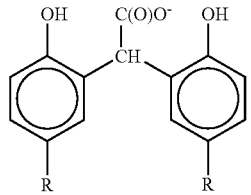

wherein each R is independently an alkyl group containing at least 4, and preferably at least 8 carbon atoms, provided that the total number of carbon atoms in all such R groups is at least 12, preferably at least 16 or 24. Alternatively, each R can be an olefin polymer substituent. The acidic material upon from which the overbased glyoxylate detergent is prepared is the condensation product of a hydroxyaromatic material such as a hydrocarbyl-substituted phenol with a carboxylic reactant such as glyoxylic acid and other omega-oxoalkanoic acids. Overbased glyoxylic detergents and their methods of preparation are disclosed in greater detail in U.S. Pat. No. 6,310,011 and references cited therein.

Another detergent can be a salicylate detergent. The alkylsalicylate can be an alkali metal salt or an alkaline earth metal salt of an alkylsalicylic acid which can in turn be prepared from an alkylphenol by Kolbe-Schmitt reaction. The alkylphenol can be prepared by a reaction of α-olefin having 8 to 30 carbon atoms (mean number) with phenol. Alternatively, calcium salicylate can be produced by direct neutralization of alkylphenol and subsequent carbonation.

Examples of the overbased detergent of the present invention include, but are not limited to calcium sulfonates, calcium glyoxylates, calcium phenates, calcium salicylates, calcium salixarates and mixtures thereof.

The amount of the overbased material, that is, the detergent, if present, is in one embodiment 0.1 to 10 percent by weight of the composition, or 0.1 to 7 percent, or 0.1 to 5 percent, or 0.2 to 3 percent by weight.

Miscellaneous

Antioxidants (that is, oxidation inhibitors) may be present, including hindered phenolic antioxidants such as 2,6,-di-t-butylphenol, and hindered phenolic esters such as the type represented by the following formula:

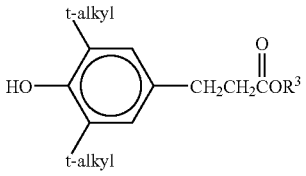

and in a specific embodiment,

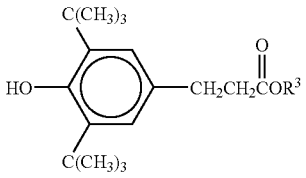

wherein $R^3$ is a straight chain or branched chain alkyl group containing 1 to 10 carbon atoms, in one embodiment 2 to 8 or 2 to 4, and in another embodiment 4 carbon atoms. In one embodiment, $R^3$ is an n-butyl group. In another embodiment $R^3$ can be 8 carbons, as found in Irganox L-135™ from Ciba. The preparation of these antioxidants can be found in U.S. Pat. No. 6,559,105.

Further antioxidants can include secondary aromatic amine antioxidants such as dialkyl (e.g., dinonyl) diphenylamine, sulfurized phenolic antioxidants, oil-soluble copper compounds, phosphorus-containing antioxidants, molybdenum compounds such as the Mo dithiocarbamates, organic sulfides, disulfides, and polysulfides (such as sulfurized Diels Alder adduct of butadiene and butyl acrylate). An extensive list of antioxidants is found in U.S. Pat. No. 6,251,840.

The amount of the antioxidant, if present, is in one embodiment 0.1 to 15 percent by weight of the composition, or 0.1 to 10 percent, or 0.1 to 7 percent, or 0.15 to 5 percent by weight.

An EP/antiwear agent which can be used in connection with the present invention is typically a zinc dialkyldithiophosphate. Although there are an extremely large number of different types of antiwear agents which might be utilized in connection with such functional fluids, zinc dialkyldithiophosphate type antiwear agents work well in connection with the other components to obtain the desired characteristics. In one embodiment, at least 50% of the alkyl groups (derived from the alcohol) in the dialkyldithiophosphate are secondary groups, that is, from secondary alcohols. In another embodiment, at least 50% of the alkyl groups are derived from isopropyl alcohol.

The zinc dihydrocarbyldithiophosphate can be present in one embodiment in an amount to provide to the lubricant composition 0.02 to 0.09 percent by weight of phosphorus, 0.05 to 0.5 percent by weight sulfur and 0.2 to 1.2 or 1.0 percent by weight sulfated ash.

Anti-foam agents can be used to reduce or prevent the formation of stable foam include silicones or organic polymers. Examples of these and additional anti-foam compositions are described in "Foam Control Agents", by Henry T. Kerner (Noyes Data Corporation, 1976), pages 125-162.

The compositions of the present invention can be employed in practice as lubricants by supplying the lubricant to an internal combustion engine (such as a stationary gas-powered internal combustion engine) in such a way that during the course of operation of the engine the lubricant is delivered to the critical parts of the engine, thereby lubricating the engine.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

The invention will be further illustrated by the following examples. While the examples are provided to illustrate the present invention, they are not intended to limit it.

Cobalt salt derivatives compound are prepared in an oil of lubricating viscosity, where the amounts of the additive components are in percent by weight, including conventional diluent oil.

The lubricants are evaluated in an oxidation and nitration test, 4 Ball Wear Scar test, the High Frequency Reciprocating Rig 1% Cumene Hydroperoxide test, the PV3344 Seal VW test, the percent viscosity increase test, and MKA24E test for wear, friction reduction and seal compatibility.

The 4 Ball wear scar procedure utilizes the same test conditions as ASTM D4172 with the addition of cumene hydroperoxide (CHP) as a lubricant pre-stress. The basic operation of the four ball wear test can be described as three stationary 0.5 diameter steel ball bearings locked in a triangle pattern. A fourth steel ball bearing is loaded against and rotated against the three stationary balls. The wear scar is measured on each of the three stationary balls using a microscope and averaged to determine the average wear scar diameter in millimeters.

The HFRR 1% CHP test is used to evaluate the friction and wear performance of lubricants containing reduced levels of phosphorus and sulfur. The wear scar diameter and percent film thickness by using a reciprocating steel ball bearing which slides against a flat steel plate is measured. This test is run using 1% cumene hydroperoxide (CHP) in conjunction with the High Frequency Reciprocating Wear Rig, which is a commercially available piece of tribology test equipment.

The MKA24E screen test is a motorized test apparatus that utilizes full scale Nissan hardware. The MKA24E screen test parameters closely mimic the parameters as seen in the ASTM seq. IVA full scale test. The oil charge is pre-stressed with contaminates & continually contaminated throughout the duration of the test. At the end of the test, post test measurements are taken. The average cam wear & maximum wear (microns) are reported.

The percent viscosity increase test, or known in the industry as the Modified IP48-Texaco test, is used to evaluate the oxidation resistance of lubricants at high temperatures. Air is sparged through a test tube containing an amount of lubricant for twenty-four hours at 200° C. The viscosity of the lubricant is measured before and after completion of the test and the percent viscosity increase is then calculated.

The oxidation and nitration tests assess the oxidation and nitration resistance of lubricants. Oxidation of the components of the lubricating oil will lead to an increase in the amount of C═O functionality present, while nitration of the components of the lubricating oil will lead to an increase in various nitrogen-containing products represented by the structures RONO2. Nitric Acid and Fe Napth are mixed into the lubricant, 50 cc/min of NOx purges the sample for 22 hours in a 145° C. bath. The end of test sample is evaluated by FTIR for percent C═O increase (peak area at 1665-1820 $cm^{-1}$) and RONO2 (peak height at 1629+/−20 $cm^{-1}$).

The PV3344 seal test utilizes the same test conditions as the PV3344 Volkswagen Seal test, which evaluates to the compatibility of lubricants with seals. AK-6 elastomers are bathed in the lubricant for 282 hours at a temperature of 150° C. Upon completion of the test the elastomers are evaluated for their tensile strength and elongation.

The following passenger car lubricant formulations are prepared in an oil of lubricating viscosity, where the amounts of the additive components are in percent by weight, unless indicated otherwise: 0.15% pour point depressant (including about 35% diluent oil), 8% viscosity index improver (including about 91% diluent oil), 0.89% additional diluent oil, 5.1% succinimide dispersant (including about 47% diluent oil), 0.48% zinc dialkyldithiophosphate (except for Example C1, which contains 0.98%) (each including about 9% diluent oil), 1.53% overbased calcium sulfonate detergent (including about 42% diluent oil), 0.1% glycerol monooleate (including about 0% diluent oil), 2.44% antioxidant (including about 5% diluent oil), 90-100 ppm of a commercial defoamer, and the remainder base oil.

To the above passenger car lubricant formulation are added the components, as found in the following table and run in the oxidation and nitration tests, 4 Ball Wear Scar test, the High Frequency Reciprocating Rig 1% Cumene Hydroperoxide test and the PV3344 Seal VW test. The results are reported in Table I.

TABLE I

| | C1 0.1% P | C2 0.05% P | Ex. 3 0.05% P | Ex. 4 0.05% P | Ex. 5 0.05% P | Ex. 6 0.05% P | Ex. 7 0.05% P |
|---|---|---|---|---|---|---|---|
| Additional Component: | | | | | | | |
| Cobalt sulfanyl acetate | | | 0.44 | | | | |
| Cobalt sulfanyl propionate | | | | 0.13 | | | |
| Cobalt sulfonate salt | | | | | 0.33 | | |
| Cobalt salicyladimine | | | | | | 0.14 | |
| Cobalt dithiophosphate | | | | | | | 0.13 |
| Cobalt (ppm) | 0 | 0 | 150 | 100 | 100 | 100 | 113 |
| Test: | | | | | | | |
| Percent nitration increase | 18 | 15.5 | 18.5 | 14 | 14.1 | 14.4 | n.r. |
| Percent carbonyl increase/−decrease | −9.9 | −12.0 | −2.5 | −12.8 | −11.3 | −11.4 | n.r. |
| 4-Ball wear scar (mm) | 0.59 | 0.61 | 0.51 | 0.54 | 0.51 | 0.4 | n.r. |
| 4-Ball Friction Coefficient | 0.11 | 0.10 | 0.09 | 0.113 | 0.09 | 0.11 | n.r. |
| HFRR Wear Scar (μm) | 161 | 295 | 212 | 183 | 212 | 181 | 197 |
| HFRR Friction Coefficient | 0.13 | 0.17 | 0.14 | 0.14 | 0.14 | 0.14 | 0.15 |
| PV 3344 Seal VW Overall Rating | pass | Fail | pass | pass | Pass | Fail | n.r. |
| Final Tensile Strength ($N/mm^2$) | 8.6 | 7.9 | 8.9 | 10.4 | 8.9 | 7.6 | n.r. |
| Final Elongation (%) | 187 | 185 | 204 | 223 | 204 | 170 | n.r. |

Note:
n.r. = not reported

The results show that formulations using cobalt salt derived compounds of the present invention in a low phosphorus passenger car lubricant (Ex. 3-7) exhibited reduced wear compared to low SAPS formulation with 0.05 percent by weight of phosphorus delivered to the composition (C2), which do not contain cobalt salt derived compounds. They further provide equivalent wear protection compared to conventional GF-3 formulations (C1), which has higher phosphorus.

The cobalt compounds are further evaluated in heavy duty diesel formulations. The following heavy duty diesel formulations are prepared in an oil of lubricating viscosity, where the amounts of the additive components are in percent by weight, including conventional diluent oil.

The following heavy duty diesel motor oil formulations are prepared in an oil of lubricating viscosity, where the amounts of the additive components are in percent by weight, unless indicated otherwise: 0.2% pour point depressant (including about 54% diluent oil), 8.2% viscosity index improver (including about 90% diluent oil), 7.2% succinimide dispersant (including about 50% diluent oil), 2.43% overbased calcium sulfonate detergent(s) (except for Example C3, which contains 2.1%) (including about 45% diluent oil), 1.63% overbased calcium sulfurized phenate detergent (present only in C3) (including about 45% diluent oil), 0.5% zinc dialkyldithiophosphate (except for C3, which contains 1.15%) (each including about 9% diluent oil), 0.031% thiadiazole corrosion inhibitor (including zero diluent oil), 0.5% ester containing sulfurized olefin (present only in C3) (including zero diluent oil), 1.31% overbased magnesium phenate (except for C3, which contains 0%) (including about 50% diluent oil), 0.6% antioxidant(s) (except for C3, which contains 0%) (including about 5% diluent oil), 90-100 ppm of a commercial defoamer, and the remainder base oil.

To the above heavy duty diesel formulation are added the components, as found in the following table and run in the percent nitration test, the percent viscosity increase test, the 4 Ball Wear Scar test, the High Frequency Reciprocating Rig 1% Cumene Hydroperoxide and the MKA24E test. The results are reported in Table II.

TABLE II

| | C3 0.11% P | C4 0.05% P | Ex. 8 0.05% P | Ex. 9 0.05% P | Ex. 10 0.05% P | Ex. 11 0.05% P | Ex. 12 0.05% P |
|---|---|---|---|---|---|---|---|
| Additional Component: | | | | | | | |
| Cobalt sulfanyl acetate | | | 0.44 | | | | |
| Cobalt sulfanyl propionate | | | | 0.13 | | | |
| Cobalt sulfonate salt | | | | | 0.33 | | |
| Cobalt salicyladimine | | | | | | 0.14 | |
| Cobalt dithiophosphate | | | | | | | 0.13 |
| Cobalt (ppm) | 0 | 0 | 102 | 98 | 108 | 98 | 108 |
| Sulfated Ash (%) | 1.22 | 1.1 | 1.08 | 1.09 | 1.09 | 1.08 | n.r. |
| Test: | | | | | | | |
| Percent Nitration Increase | 12.0 | 42.2 | 46.5 | 43.3 | 41.4 | 36.3 | n.r. |
| Percent Viscosity Increase | 33.0 | 71 | 5.0 | 2.3 | 5.1 | 2.8 | n.r. |
| 4-Ball wear scar (mm) | 0.48 | 0.45 | 0.60 | 0.60 | 0.54 | 0.383 | n.r. |
| 4-Ball Friction Coefficient | 0.11 | 0.11 | 0.10 | 0.11 | 0.10 | 0.11 | n.r. |
| HFRR Ball Scar (μm) | 165 | 214 | 199 | 156 | 169 | 177 | 189 |
| HFRR Friction Coefficient | 0.15 | 0.16 | 0.15 | 0.14 | 0.15 | 0.14 | 0.15 |
| MKA24E Average Wear | 28 | 77 | 29 | n.r. | n.r. | n.r. | n.r. |
| MKA24E Maximum Wear | 38 | 349 | 37 | n.r. | n.r. | n.r. | n.r. |

Note:
n.r. = not reported

The results show that formulations using cobalt salt derived compounds of the present invention in a low phosphorus heavy duty diesel lubricant (Ex. 8-11) exhibit reduced wear compared to a formulation with 0.05 percent by weight of phosphorus delivered to the composition (C4), which do not contain cobalt salt derived compounds. They further provide equivalent wear protection compared to conventional heavy duty diesel formulations (C3), which has higher phosphorus.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What we claim:

1. A low phosphorus internal combustion engine lubricant composition comprising:

(a) an oil of lubricating viscosity;

(b) an oil soluble cobalt complex or salt; and (c) a succinimide dispersant; and (d) a high TBN calcium sulfonate detergent;

wherein (b) the oil soluble cobalt complex or salt is selected from the group consisting of hydrocarbyl substituted cobalt sulfanyl alkanoates, hydrocarbyl substituted cobalt sulfonates, hydrocarbyl substituted cobalt salicylaldimines, cobalt di-hydrocarbyldithiocarbamates, and hydrocarbyl substituted cobaltdithiophosphates; and wherein the amount of (b) the cobalt complex or salt is present in an amount to deliver about 25 to about 400 ppm by weight cobalt;

wherein the composition further comprises a zinc dihydrocarbyldithiophosphate of which at least about 50 percent of the alkyl groups thereof are secondary alkyl groups;

wherein the composition has a sulfated ash content of from 0.4 to 1.2 percent by weight.

2. The composition of claim 1 further comprising an antioxidant.

3. The composition of claim 2 wherein said antioxidant is at least one of hindered phenol or aromatic amine.

4. The composition of claim 3 wherein the amount of said antioxidant is about 0.1 to about 5.0 percent by weight.

5. The composition of claim 2 wherein the antioxidant is a hindered phenolic ester, the alcohol-derived moiety of said ester containing 1 to about 8 carbon atoms.

6. The composition of claim 1 wherein the amount of the zinc dihydrocarbyldithiophosphate is an amount to provide about 0.02 to about 0.09 percent by weight phosphorus.

7. The composition of claim 1 wherein the amount of the succinimide dispersant is about 1.5 to about 10.0 percent by weight.

8. The composition of claim 1 wherein the composition has a phosphorus content of about 50 to about 800 ppm and a sulfur content of up to about 0.4 percent by weight.

9. The composition of claim 8 wherein the amount of said detergent is about 0.2 to about 3.0 percent by weight.

10. A method of lubricating an internal combustion engine comprising the steps of:

(I) supplying to said engine a low phosphorus internal combustion engine lubricant composition comprising:

(a) an oil of lubricating viscosity;

(b) an oil soluble cobalt complex or salt; and (c) a succinimide dispersant; and (d) a high TBN calcium sulfonate detergent;

wherein (b) the oil soluble cobalt complex or salt is selected from the group consisting of hydrocarbyl substituted cobalt sulfanyl alkanoates, hydrocarbyl substituted cobalt sulfonates, hydrocarbyl substituted cobalt salicylaldimines, cobalt di-hydrocarbyldithiocarbamates, and hydrocarbyl substituted cobalt dithiophosphates; and wherein the amount of (b) the cobalt complex or salt is present in an amount to deliver about 25 to about 400 ppm by weight cobalt;

wherein the composition further comprises a zinc dihydrocarbyldithiophosphate of which at least about 50 percent of the alkyl groups thereof are secondary alkyl groups.

* * * * *